US006836636B2

(12) United States Patent
Saito

(10) Patent No.: US 6,836,636 B2
(45) Date of Patent: Dec. 28, 2004

(54) TRANSFER ROLLER AND IMAGE-FORMING APPARATUS

(75) Inventor: Miho Saito, Kanagawa (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 10/362,422

(22) PCT Filed: Aug. 23, 2001

(86) PCT No.: PCT/JP01/07218

§ 371 (c)(1),
(2), (4) Date: Feb. 25, 2003

(87) PCT Pub. No.: WO02/17021

PCT Pub. Date: Feb. 28, 2002

(65) Prior Publication Data

US 2004/0033091 A1 Feb. 19, 2004

(30) Foreign Application Priority Data

Aug. 25, 2000 (JP) ..... 2000-255306

(51) Int. Cl.[7] ..... G03G 15/16
(52) U.S. Cl. ..... 399/313; 492/59
(58) Field of Search ..... 399/313, 176, 399/279, 286, 333, 357; 492/17–18, 59, 56

(56) References Cited

U.S. PATENT DOCUMENTS

| | | | | | |
|---|---|---|---|---|---|
| 5,659,854 | A | * | 8/1997 | Masuda et al. | 399/176 |
| 5,834,116 | A | | 11/1998 | Sawa et al. | |
| 5,863,626 | A | * | 1/1999 | Yamasaki | 428/36.5 |
| 6,096,395 | A | * | 8/2000 | Hayashi et al. | 428/35.9 |
| 6,179,761 | B1 | * | 1/2001 | Isoda et al. | 492/59 |
| 6,272,301 | B1 | * | 8/2001 | Kawada et al. | 399/148 |
| 6,343,199 | B1 | * | 1/2002 | Kodama | 399/174 |

* cited by examiner

*Primary Examiner*—Robert Beatty
(74) *Attorney, Agent, or Firm*—Sughrue Mion, PLLC

(57) ABSTRACT

The transfer roller of the present invention is a member comprising a shaft and an elastic foamed material layer provided on an outer circumference of the shaft and electrifying a recording medium to transfer a developer onto the above recording medium, wherein the elastic foamed material layer described above has an average cell diameter of 300 to 400 $\mu$m, and at least 80% of the whole cells has a cell diameter falling in a range of the average value ±200 $\mu$m. It is a transfer roller which provides a good transferred image having no image unevenness.

5 Claims, 1 Drawing Sheet

TRANSFER ROLLER AND IMAGE-FORMING APPARATUS

BACKGROUND OF THE INVENTION

The present invention relates to a transfer roller, more specifically to a transfer roller in which an elastic foamed material layer less scattered in a size of a cell and having a uniform cell diameter is provided on an outer circumference of a shaft and which can give a good transferred image.

RELATED ART

In an electrophotographic apparatus and an electrostatic recording apparatus such as a copying machine and a laser printer, a transfer roller has so far been used as a member for electrifying a recording medium such as paper, OHP (overhead projector) and a belt to transfer a developer onto this recording medium. For example, in a color copying machine, in an image-forming method in which a charged insulating toner image carried on an image carrier is primarily transferred onto an intermediate transfer medium and in which this is then secondarily transferred onto a recording medium from the intermediate transfer medium, used is a transfer roller for secondary transfer for electrifying the recording medium to transfer a toner image on the intermediate transfer medium onto the recording medium.

In a laser printer, in an image-forming method in which a charged insulating toner image carried on an image carrier is transferred onto a recording medium, used is a transfer roller for electrifying the recording medium to transfer the toner onto the recording medium from an electrostatic latent image visualized by the toner.

An apparatus shown in the following FIG. 1 can be given as the example of the image-forming apparatus such as the laser printer. FIG. 1 is a schematic drawing showing one example of an image-forming apparatus such as a laser printer using a transfer roller, and a photosensitive drum 1 is uniformly electrified by means of a charger 2. Next, an electrostatic latent image is formed by means of an image exposing system 3 and visualized by means of a developing device 4 to become a toner image. When the toner image on the photosensitive drum reaches a contact area with a transfer roller 5, the toner image is pressed onto a record paper 10 which is transported synchronizing therewith, and voltage is applied on the transfer roller 5 from a bias electric source 8, so that the toner image is transferred onto the record paper 10 from the photosensitive durm 1. In the drawing, a code 6 is a bearing; 7 is a spring; and 9 is a cleaner.

The transfer roller used for this image-forming apparatus has a structure in which an elastic layer is formed on an outer circumference of a shaft usually comprising a good conductive material such as metal using a material obtained by providing a principal material including a rubber-like elastic material such as silicon rubber, NBR and EPDM and a polyurethane foam with conductivity by blending with a conductive agent. In this respect, a hardness of the elastic layer has to be low in order to obtain a uniform nip between a photosensitive drum or an intermediate transfer medium and a transfer roller and to obtain a suitable transfer amount which meets a high speed of the apparatus.

In such transfer roller, when an elastic foamed material layer is provided as the elastic layer described above, an average cell diameter thereof and a scattering range in the cell diameter are very important. If the average cell diameter deviates from a prescribed range, it is difficult to obtain a good transferred image having no image unevenness. If a scattering range in the cell diameter is large, the roller resistance becomes uniform, and scattering in light and shade is liable to be caused in a density of the transferred image. Further, if ones having a large cell diameter and a small cell diameter are present in a mixture, brought about is the unfavorable situation that the transferred image is striped in a certain case.

DISCLOSURE OF THE INVENTION

Under such circumstances, an object of the present invention is to provide a transfer roller having an elastic foamed material layer provided on an outer circumference of a shaft, which does not cause scattering in light and shade in the image density and does not make the transferred image striped and which provides a good transferred image having no image unevenness.

Intensive researches repeated by the present inventors in order to develop a transfer roller having the excellent performances described above have resulted in finding that a transfer roller provided with an elastic foamed material layer which has an average cell diameter falling in a specific range and in which scattering in the cell diameter falls in a specific range on an outer circumference of a shaft can meet the object thereof. The present invention has been completed based on such knowledge.

That is, the present invention provides a transfer roller comprising a shaft and an elastic foamed material layer provided on an outer circumference of the shaft and electrifying a recording medium to transfer a developer onto the above recording medium, wherein the above elastic foamed material layer has an average cell diameter of 300 to 400 $\mu$m, and at least 80% of the whole cells has a cell diameter falling in a range of the average value ±200 $\mu$m. Further, the present invention provides an image-forming apparatus equipped with this transfer roller.

BEST MODE FOR CARRYING OUT THE INVENTION

Figure 1:
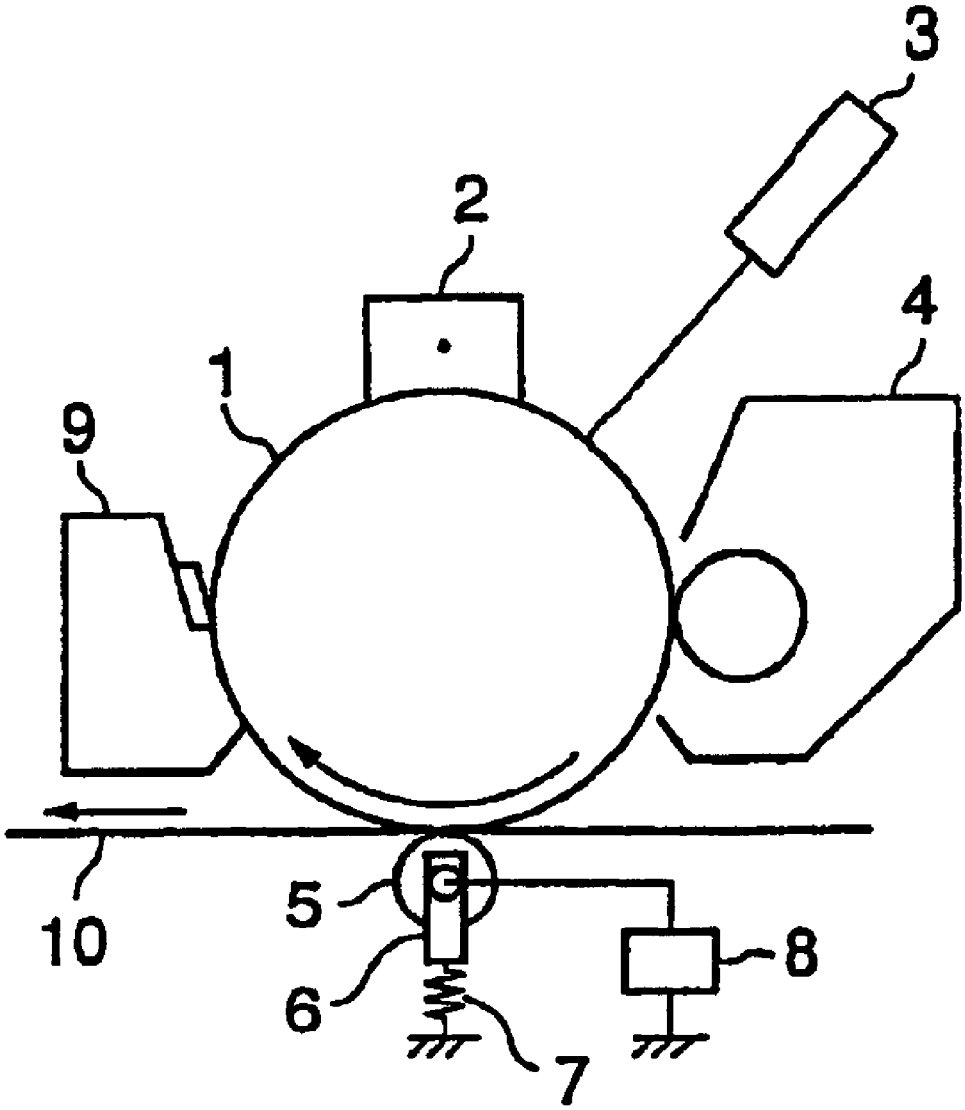
FIG. 1 PRIOR ART
FIG. 1 is a schematic drawing showing one example of an image-forming apparatus using a transfer roller, wherein 1 shows a photosensitive drum; 2 shows a charger; 3 shows an image exposing system; 4 shows a developing device; and 5 shows a transfer roller.

The transfer roller of the present invention comprises a shaft and an elastic foamed material layer provided on an outer circumference of the shaft. The material of the elastic foamed material layer described above shall not specifically be restricted, and capable of being given are, for example, elastomers such as polyurethane, ethylene-propylene-diene rubber (EPDM), ethylene-propylene rubber (EPR), natural rubber, butyl rubber, nitrile rubber, polyisoprene rubber, polybutadiene rubber, silicon rubber, styrene-butadiene rubber, chloroprene rubber and acryl rubber. They may be used alone or in combination of two or more kinds thereof. Among them, polyurethane is particularly preferred.

In the elastic foamed material layer in the present invention, the average cell diameter has to fall in a range of 300 to 400 $\mu$m. If this average cell diameter is less than 300 $\mu$m, inferior transfer is liable to be caused. On the other hand, if it exceeds 400 $\mu$m, image unevenness tends to be produced. In both cases, a good transferred image is less liable to be obtained. Further, at least 80% of the whole cells has to have a cell diameter falling in a range of the average value ±200 μm. If 20% or more of the whole cells has a cell diameter deviating from the range described above, scattering in the roller resistance grows large. Particularly when it has a cell diameter exceeding [average value +200 μm], scattering in light and shade is liable to be caused in the image density, and if the cells having a cell diameter exceeding [average value +200 μm] and the cells having a cell diameter small than [average value −200 μm] are present as a mixture, the image is liable to be striped.

Because of such reasons, preferably 85% or more, more preferably 90% or more and particularly preferably 95% or more of the whole cells preferably has a cell diameter falling in a range of the average value ±200 μm.

The average cell diameter and scattering in the cell diameter each described above can be determined according to the following method.

A foam is cut out from the roller. Gold is deposited on a smooth face of the foam, and it is observed under a scanning type electron microscope at a magnification of 50 times to determine the cell diameter and the cell number observed in the field of view of 25 mm×95 mm.

This elastic foamed material layer has a cell number per 25 mm falling in a range of 45 or more, an Ascar C hardness falling in a range of 50 degree or less, preferably 30 to 45 degree and a volume resistivity falling in a range of $1\times10^6$ to $1\times10^9$ Ω·cm in applying a voltage of 1000 V under the environment of a temperature of 22° C. and a humidity of 55%.

The cell number per 25 mm was visually measured, and the Ascar C hardness was measured according to JIS K6301.

A production process for the elastic foamed material in the foregoing elastic foamed material layer in the present invention shall not specifically be restricted and can suitably be selected from conventionally know processes, for example, a gas mixing process, a foaming agent decomposition process (an atmospheric pressure foaming process, a press foaming process, an extrusion foaming process and an injection foaming process), a solvent volatilization process, a chemical reaction process and a sintering process according to the kind of the high molecular materials used. Also, the cell diameter of the resulting foamed material can be controlled to the range described above by suitably selecting the foaming conditions according to the kind of the high molecular materials and the production process for the foamed material.

In the present invention, the above elastic foamed material layer is preferably a polyurethane foam layer containing a conductivity-providing agent, and when the elastic foamed material layer is such polyurethane foam layer, preferably used is a process in which the polyurethane molding material and inert gas are mixed by mechanical stirring and foamed and cured to prepare the polyurethane foam.

In such process, the cell diameter can be controlled to the range described above by suitably selecting the respective components constituting the polyurethane molding material, for example, the polyol component, the isocyanate component and the foam-setting agent and further selecting a shape and a stirring speed of a stirring blade for mechanical stirring, a blowing speed of inert gas and a temperature and a pressure in forming foams or curing by heating.

In particular, it is important to select the respective components constituting the polyurethane molding material. In the present invention, preferred as the polyurethane foam layer from the viewpoint of an easiness in controlling the cell diameter is one obtained by foaming and curing the polyurethane molding material comprising (A) the polyetherpolyol which has a weight average molecular weight of 1,000 to 15,000 and in which a proportion of a primary hydroxyl group in terminal hydroxyl groups is 50 mole % or more, (B) the polyisocyanate compound, (C) the conductivity-providing agent and (D) the silicon base foam-setting agent comprising a polyorganosiloxane-polyalkylene oxide copolymer by using an inert gas and mechanical stirring in combination.

Preferred as the polyetherpolyol of the component (A) described above are compounds obtained by subjecting propylene glycol, ethylene glycol, glycerin, trimethylolpropane and hexanetriol used as a starting material to addition polymerization with alkylene oxides, and particularly suited are compounds obtained by subjecting glycerin to addition polymerization with ethylene oxide or ethylene oxide and propylene oxide. An addition mole number of ethylene oxide or ethylene oxide and propylene oxide described above is selected so that a weight average molecular weight of the resulting polyetherpolyol falls in a range of 1,000 to 15,000. If the weight average molecular weight deviates from the range described above, the polyurethane foam having desired physical properties is less liable to be obtained. The preferred weight average molecular weight falls in a range of 2,000 to 8,000.

In this polyetherpolyol, a proportion of a primary hydroxyl group in the terminal hydroxyl groups is 50 mole % or more. If the proportion of this primary hydroxyl group is less than 50 mole %, the polyurethane foam having a cell diameter controlled to the range described above is less liable to be obtained, and the object of the present invention is not achieved in a certain case. The preferred proportion of this primary hydroxyl group is 60 mole % or more, particularly preferably 70 mole % or more.

A proportion of a primary hydroxyl group in terminal hydroxyl groups can quantitatively be determined by measuring a proton nuclear magnetic resonance spectrum ($^1$H-NMR).

The alkylene oxide subjected to addition polymerization with glycerin may be either ethylene oxide or a combination of ethylene oxide and propylene oxide. When ethylene oxide is combined with propylene oxide to subject them to addition polymerization, a use proportion of them shall not specifically be restricted, but they have to be subjected to addition polymerization by such a method that a proportion of a primary hydroxyl group in the terminal hydroxyl groups comes up to 50 mole % or more.

An oxyethylene group and an oxypropylene group in the molecular chain are arranged preferably at random.

In the polyurethane molding material used in the present invention, the polyetherpolyols may be used alone or in combination of two or more kinds thereof as the component (A).

In the polyurethane molding material, the polyisocyanate compound used as the component (B) includes, for example, various aromatic polyisocyanate compounds such as diphenylmethanediisocyanate and tolylenediisocyanate or derivatives thereof, various aliphatic polyisocyanate compounds such as hexamethylenediisocyanate or derivatives thereof and alicyclic polyisocyanate compounds such as isophoronediisocyanate or derivatives thereof. Among these polyisocyanate compounds, various aromatic polyisocyanate compounds or derivatives thereof are particularly preferred since the cell diameter is stabilized when the polyurethane molding material is foamed and cured by using an inert gas and mechanical stirring in combination.

The aromatic polyisocyanate compound includes polynuclear compounds, and capable of being used are pure diphenylmethanediisocyanate obtained from diaminodiphenylmethane and polymericdiphenylmethanediisocyanate obtained from polynuclear compounds of diaminodiphenylmethane. The number of functional groups contained in polymericdiphenylmethanediisocyanate shall not specifically be restricted. Usually used is a mixture of pure diphenylmethanediisocyanate and polymericdiphenylmethanediisocyanate having various functional group numbers, and used is the mixture having an average functional group number of preferably 2.05 to 4.00, more preferably 2.50 to 3.50. Further, any polyisocyanate compounds can be used in the form of derivatives, and used are urethane-modified products obtained by modifying with polyols, dimmers obtained by forming urethidione, isocyanurate-modified products, carbodiimide/urethoneimine-modified products, allophanate-modified products, urea-modified products and buret-modified products. The urethane-modified products and the carbodiimide/urethoneimine-modified products are particularly preferred. These polyisocyanate compounds may be used alone or in combination of two or more kinds thereof. Further, several kinds of diphenylmethanediisocyanate and the derivatives thereof can be blended and used as well. Also, the other aromatic polyisocyanate compounds such as tolylenediisocyanate, various aliphatic polyisocyanate compounds such as hexamethylenediisocyanate and alicyclic polyisocyanate compounds such as isophoronediisocyanate or the derivatives thereof are not prevented from being used in combination with diphenylmethanediisocyanate and the derivatives thereof as long as the advantages of the present invention are not damaged.

The component (A) and the component (B) each described above are advantageously used in such a proportion that an NCO group/OH group mole ratio falls in a range of 0.9 to 1.5, preferably 1.0 to 1.2.

A carbon conductive agent and an ion conductive agent can be used as the conductivity-providing agent of the component (C) in the polyurethane molding material. The carbon conductive agent includes, for example, oil furnace black including gas black such as electrification black, Koetchen black and acetylene black and ink black, thermal black, channel black and lamp black. The ion conductive agent includes, for example, ammonium salts of perchlorates, chlorates, hydrochlorides, bromates, iodates, borofluorides, sulfates, alkylsulfates, carboxylates and sulfonates including tetraethylammonium, tetrabutylammonium, dodecyltrimethylammonium such as lauryltrimethylammonium, octadecyltrimethylammonium such as stearyltrimethylammonium, hexadecyltrimethylammonium, benzyltrimethylammonium and modified aliphatic dimethylethylammonium; and perchlorates, chlorates, hydrochlorides, bromates, iodates, borofluorides, trifluoromethylsulfates and sulfonates of alkaline metals or alkaline earth metals such as lithium, sodium, calcium and magnesium. Among them, the ion conductive agents are preferred, and quaternary ammonium salts of alkylsulfates and ammonium salts of polybasic carboxylic acids are particularly suited since an increase in the resistance is small in continuously applying an electric current.

These conductive agents may be used alone or in combination of two or more kinds thereof. A blending amount thereof shall not specifically be restricted and is suitably selected according to various situations. Usually, it is blended in a proportion of 0.1 to 40 parts by weight, preferably 0.3 to 20 parts by weight per 100 parts by weight of the high molecular material constituting the polyurethane foam.

A polyorganosiloxane-polyalkylene oxide copolymer is used as the silicon base foam-setting agent of the component (D) in the polyurethane molding material.

The polyorganosiloxane constituting the polyorganosiloxane-polyalkylene oxide copolymer described above shall not specifically be restricted, and various compounds can be used, and polydimethylsiloxane is suited from the viewpoints of the effects and the profitability. On the other hand, ethylene oxide addition polymerization products or addition copolymerization products of ethylene oxide and propylene oxide are preferred as the polyalkylene oxide. In the case of the addition copolymerization products of ethylene oxide and propylene oxide, they are preferably used in a proportion of 50 to 100 mole % of ethylene oxide and 50 to 0 mole % of propylene oxide.

When the polyurethane molding material is foamed and cured by using introduction of inert gas and mechanical stirring in combination, use of such silicon base foam-setting agent stabilizes the cell diameter and makes it easy to obtain the desired polyurethane foam.

The silicon base foam-setting agents may be used alone or in combination of two or more kinds thereof. Further, ionic surfactants such as cationic, anionic and amphoteric surfactants and nonionic surfactants such as various polyethers and polyesters may be used, if desired, in combination with the silicon base foam-setting agents.

A blending amount of the silicon base foam-setting agent falls usually in a range of preferably 0.1 to 10 parts by weight, particularly preferably 0.5 to 5 parts by weight per 100 parts by weight of the polyetherpolyol of the component (A) described above.

This polyurethane molding material can be blended, if desired, with a urethane reaction catalyst and an inorganic powder material such as magnesium carbonate, calcium carbonate and magnesium oxide.

Capable of being used alone or in combination of two or more kinds thereof as the urethane reaction catalyst described above are, for example, publicly known catalysts including monoamines such as triethylaminie and dimethylcyclohexylamine; diamines such as tetramethylethylenediamine, tetramethylpropanediamine and tetramethylhexanediamine; triamines such as pentamethyldiethylenetriamine, pentamethyldipropylenetriamine and tetramethylguanidine; cyclic amines such as triethylenediamine, dimethylpiperazine, methylethylpiperazine, methylmorpholine, dimethylaminoethylmorpholine and dimethylimidazole; alcohol amines such as dimethylaminoethanol, dimethylaminoethoxyethanol, trimethylaminoethylethanolamine, methylhydroxyethylpiperazine and hydroxyethylmorpholine; ether amines such as bis(dimethylaminoethyl) ether and ethylene glycol bis (dimethyl)aminopropyl ether; and organic metal compounds such as stannous octoate, dibutyltin diacetate, dibutyltin dilaurate, dibutyltin mercaptide, dibutyltin thiocarboxylate, dibutyltin dimaleate, dioctyltin mercaptide, dioctyltin thiocarboxylate, phenylmercury propionate and octanoates. Among them, the organic metal compounds such as stannous octoate, dibutyltin diacetate, dibutyltin dilaurate, dibutyltin mercaptide, dibutyltin thiocarboxylate, dibutyltin dimaleate, dioctyltin mercaptide, dioctyltin thiocarboxylate, phenylmercury propionate and octanoates are particularly preferred from the viewpoint that the cell diameter is stabilized when the polyurethane molding material is foamed and cured by using introduction of inert gas and mechanical stirring in combination.

Capable of being used as the production process for the polyurethane foam is, for example, a process in which inert gas is introduced into the polyurethane molding material comprising the polyetherpolyol of the component (A), the polyisocyanate compound of the component (B), the conductivity-providing agent of the component (C), the silicon base foam-setting agent of the component (D) and, if desired, the urethane reaction catalyst while mechanically stirring them to mix air bubbles thereinto and in which this is injected into a prescribed mold or freely foamed in the form of a block and then cured by heating or a prepolymer process in which polyetherpolyol is reduced in advance to isocyanate and in which it is foamed and cured in the same manner as described above using a chain extending agent such as ethylene glycol, 1,4-butanediol and trimethylolpropane.

Usually used as the shaft used in the transfer roller of the present invention are metal members obtained by plating steel products such as sulfur free-cutting steel with zinc and metal members such as aluminum and stainless steel. Also, the surface of the foamed material layer may be coated with a conductive, semi-conductive or insulating coating material.

A method for bonding the metal member with the conductive polyurethane foam obtained in the manner described above shall not specifically be restricted, and capable of being used are a method in which the metal member is disposed in advance in a an inside of die and in which the polyurethane molding material is injected thereinto and cured and a method in which the conductive polyurethane foam is molded in a prescribed form and then adhered to the metal member. In either method, an adhesive layer can be provided, if necessary, between the metal member and the conductive polyurethane foam, and publicly known materials such as an adhesive and a hot melt sheet each comprising a conductive coating material can be used for this adhesive layer.

A molding method for the above conductive polyurethane foam shall not specifically be restricted, and capable of being used in addition to the foregoing method in which the polyurethane foam is injected into a die having a prescribed form are publicly known methods, for example, a method in which the polyurethane foam is cut out from a block in a prescribed dimension by cutting work, a method in which the polyurethane foam is worked into a prescribed dimension by polishing treatment and a method in which these methods are suitably combined.

Next, the present invention shall be explained in further details with reference to examples, but the present invention shall by no means be restricted by these examples.

EXAMPLES 1

Propylene oxide and ethylene oxide were added at random to glycerin to produce polyetherpolyol having a content of an oxyethylene unit of 20% by weight, a functional group number of substantially 3, a weight average molecular weight of 5,000, an OH value of 34 mg KOH/g and a primary hydroxyl group content of 75 mole % in terminal hydroxyl groups.

Mixed while foaming by mechanical stirring were 60 parts by weight of this polyetherpolyol, 40 parts by weight of polytetramethylene ether glycol having a weight average molecular weight of 2,000 and an OH value of 56 mg KOH/g, 15 parts by weight of a mixed isocyanate component having an isocyanate group content of 26.3% by weight which was a mixture of diphenylmethanediisocyanate, urethane-modified diphenylmethanediisocyanate and carbodiimide-modified diphenylmethanediisocyanate, 4 parts by weight of a silicon base foam-setting agent which was a dimethylpolysiloxane-polyoxyalkylene copolymer, 1 part by weight of lauroyliminopropyldimethylethylammonium ethylsulfate and 0.005 part by weight of dibutyltin dilaurate, and the mixture thereof was injected into a die in which a metal-made shaft having a diameter of 6 mm was disposed in a center thereof. Then, it was cured by heating at 100° C. for 10 hours to prepare a polyurethane foam-made roller having a diameter of 16.5 mm and a length of 215 mm.

The foam layer had an average cell diameter of 320 $\mu$m, and both of the cells having a cell diameter exceeding 520 $\mu$m and the cells having a cell diameter of less than 120 $\mu$m were not substantially present. It had an Ascar C hardness of 38 degree, a cell number of 53 per 25 mm and a volume resistivity of $1\times10^{7.3}$ Ω·cm.

The roller described above was installed in an image-forming apparatus shown in FIG. 1 as a transfer roller. Gray scale, black solid and white solid images were printed in the environment of a temperature of 15° C. and a humidity of 10% to obtain the good images having no image unevenness.

Comparative Examples 1

A polyurethane foam-made roller was prepared in the same manner as in Example 1, except that in Example 1, 4.0 parts by weight of a nonionic surfactant (brand name [Emulgen 106] manufactured by Kao Corporation) was substituted for the silicon base foam-setting agent as a foam-setting agent.

The foam layer had an average cell diameter of 420 $\mu$m, and the cells having a cell diameter exceeding 500 $\mu$m were present in a proportion of 50% based on the whole cells. It had an Ascar C hardness of 35 degree, a cell number of 40 per 25 mm and a volume resistivity of $1\times10^{7.5}$ Ω·cm.

This polyurethane foam-made roller was used to print images in the same manner as in Example 1 to find that scattering in light and shade was caused in the image density and that the good images were not obtained.

INDUSTRIAL APPLICABILITY

In the transfer roller of the present invention, the elastic foamed matter layer which is less scattered in a size of a cell and has a uniform cell diameter is provided on an outer circumference of the a shaft. It does not cause scattering in light and shade in the image density and does not make the transferred image striped, and it can provide a good transferred image having no image unevenness.

What is claimed is:

1. A transfer roller comprising a shaft and an elastic foamed material layer provided on an outer circumference of the shaft and electrifying a recording medium to transfer a developer onto the above recording medium, wherein the above elastic foamed material layer has an average cell diameter of 300 to 400 $\mu$m, and at least 80% of the whole cells has a cell diameter falling in a range of the average value ±200 $\mu$m.

2. The transfer roller as described claim 1, wherein the elastic foamed material layer has a cell number per 25 mm of 45 or more, an Ascar C hardness of 50 degree or less and a volume resistivity of $1\times10^{6}$ to $1\times10^{9}$ Ω·cm in applying a voltage of 1000 V under the environment of a temperature of 22° C. and a humidity of 55%.

3. The transfer roller as described claim 1, wherein the elastic foamed material layer is a polyurethane foam layer containing a conductivity-providing agent.

4. The transfer roller as described claim 3, wherein the polyurethane foam layer is obtained by mixing an inert gas with a polyurethane molding material comprising (A) polyetherpolyol which has a weight average molecular weight of 1,000 to 15,000 and in which a proportion of a primary hydroxyl group in terminal hydroxyl groups is 50 mole % or more, (B) a polyisocyanate compound, (C) a conductivity-providing agent and (D) a silicon base foam-setting agent comprising a polyorganosiloxane-polyalkylene oxide copolymer by mechanical stirring and foaming and curing it.

5. An image-forming apparatus equipped with the transfer roller as described in any of claims 1 to 4.

* * * * *